US005854955A

United States Patent [19]

Yawata et al.

[11] Patent Number: 5,854,955

[45] Date of Patent: Dec. 29, 1998

[54] PROCESS CARTRIDGE

[75] Inventors: Katumi Yawata; Shuichi Goi; Eiji Kurosawa, all of Ueda, Japan

[73] Assignee: Matsushita Graphic Communications Systems, Inc., Japan

[21] Appl. No.: 882,072

[22] Filed: Jun. 25, 1997

[30] Foreign Application Priority Data

Jan. 16, 1997 [JP] Japan ..... 9-005184

[51] Int. Cl.[6] ..... G03G 21/16

[52] U.S. Cl. ..... 399/111; 399/113; 399/114

[58] Field of Search ..... 399/110, 111, 399/113, 102, 103, 105, 119, 120

[56] References Cited

U.S. PATENT DOCUMENTS 4,987,446 1/1991 Mochimaru et al. ..... 399/113

5,294,960 3/1994 Nomura et al. ..... 399/113

5,583,618 12/1996 Takeuchi et al. ..... 399/111

*Primary Examiner*—Arthur T. Grimley

*Assistant Examiner*—Hoan Tran

*Attorney, Agent, or Firm*—Parkhurst & Wendel

[57] ABSTRACT

A process cartridge case including a toner hopper, and a discharged toner box disposed at both sides of a drum housing accommodating a photoconductive drum. The process cartridge case is separable into first and second parts at a border in a region of the drum housing. Legs are provided on an outer surface of the toner hopper so that the process cartridge can be placed in an upright position during a refilling operation.

An agitator extends beyond a side wall in a cantilever fashion to allow a box with a bearing member to rotatably support the agitator shaft. An elastic member is included in the box to hermetically seal the agitator shaft and prevent toner leakage.

7 Claims, 14 Drawing Sheets

PROCESS CARTRIDGE

BACKGROUND OF THE INVENTION

1. Field of the Invention

The invention relates to a process cartridge used for an electrophotographic apparatus, such as a laser printer, a facsimile machine and a copy machine.

2. Prior Art

A conventional process cartridge comprises a process cartridge case made of a resin, in which a toner hopper is formed for storing toner supplied to a developing section and a discharged toner box is formed for storing used toner. Furthermore, a photoconductive drum, a developing roller and a discharging roller are assembled in the process cartridge case and used as a process cartridge unit. In general, this kind of process cartridge is disposable.

However, main materials constituting the process cartridge are plastic, rubber and metal. This forces each consumer to do a troublesome work for separating the wasted parts into different categories determined for efficiency in the waste or garbage collection. Furthermore, from the view point of environmental problems, it is desirable to recycle the useful materials.

To solve these problems, one of prospective methods is to refill the process cartridge. In refilling the process cartridge, a series of reproduction processes are generally required for disassembling and cleaning each collected process cartridge, replacing damaged or worn parts with new ones, filling fresh toner, and reassembling the parts.

However, according to this refill method, the following problems need to be solved:

i) during a disassembling operation of the process cartridge, there is a possibility that the toner may leak out of the toner hopper and contaminate various parts, working place and the worker;

ii) if a large number of parts need to be disassembled, the assembling and disassembling operations may be complicated and time consuming;

iii) when a rotary member, such as a charging roller, is removed from or installed to the process cartridge case, there is a possibility that a holder member protruding integrally from the process cartridge case for supporting an axial end of this rotary member may be fatally broken and the process cartridge case may be no longer used for accommodating the rotary member; and iv) a seal member is provided for preventing the toner from leaking from the clearance between the side wall of the toner hopper and an agitator shaft; however, this seal member cannot be exchanged easily.

SUMMARY OF THE INVENTION

In view of the above-described problems, the present invention has an object to provide a refillable process cartridge which is capable of preventing a leakage of toner during a disassembling operation.

Another object of the present invention is to provide a refillable process cartridge which is capable of reducing the number of parts to be disassembled.

Still another object of the present invention is to provide a refillable process cartridge case which needs not be wasted even if the holder member is broken.

Yet another object of the present invention is to provide a refillable process cartridge case which assures an easy exchange of a seal member provided adjacent to an agitator shaft.

In order to accomplish the above and other related objects, a first aspect of the present invention provides a process cartridge comprising a photoconductive drum disposed in a drum housing formed in a process cartridge case. A toner hopper and a discharged toner box are formed in the process cartridge case, so that the drum housing is interposed between the toner hopper and the discharged toner box. At least one leg is provided on an outer surface of the process cartridge case at a region corresponding to the toner hopper, so that the process cartridge case is held upright by the leg. And, the process cartridge case comprises a plurality of parts separable along a border in a region of the drum housing.

Preferably, the process cartridge case is opened by removing the discharged toner box.

A second aspect of the present invention provides a process cartridge comprising a process cartridge case having a drum housing accommodating a photoconductive drum. The process cartridge case is separable into a first part and a second part along a border in a region of the drum housing. A drum holder is provided for engaging the photoconductive drum with the process cartridge case. The first part has a side plate with a support hole opened at a position corresponding to an axial end of the photoconductive drum. The support hole including a stopper. The drum holder comprises a drum holder shaft rotatably supporting the photoconductive drum, a coupling portion coupled with the support hole of the side plate of the first part, and a secondpart holder shaft having a radial size smaller than a maximum radial size of the coupling portion. The second part has a connecting portion with a bearing groove engageable with the second-part holder shaft of the drum holder, so that the second part is joined with the first part by coupling the bearing groove with the second-part holder shaft supported on the side plate of the first part, while the connecting portion of the second part prevents the drum holder from being pulled out in an axial direction.

Furthermore, a third aspect of the present invention provides a process cartridge comprising a process cartridge case having a drum housing accommodating a photoconductive drum. The process cartridge case is separable into a first part and a second part along a border in a region of the drum housing. A drum holder is provided for engaging the photoconductive drum with the process cartridge case. The first part has a toner hopper and a side plate with a support hole. The support hole, including a stopper, is opened at a position corresponding to an axial end of the photoconductive drum. The drum holder comprises a drum holder shaft rotatably supporting the photoconductive drum, a coupling portion coupled with the support hole of the side plate of the first part, and a second-part holder shaft having a narrow width when seen from a specific angular direction. The second part has a discharged toner box and a connecting portion with a bearing groove necked at an open end and engageable with the second-part holder shaft of the drum holder, so that the second part is joined with the first part by coupling the bearing groove with the second-part holder shaft supported on the side plate of the first part. And, the second part is detachable from the first part only when the necked open end of the bearing groove faces toward the second-part holder shaft and moves in the specific angular direction, so that an inlet of the discharged toner box is directed upward obliquely when the second part is removed from the first part under a condition where the process cartridge case is placed upright with the toner hopper bottomed.

Still further, a fourth aspect of the present invention provides a process cartridge comprising a process cartridge case, a rotary member provided at a predetermined position in the process cartridge case, and a holder means for rotatably supporting an axial end of the rotary member. The holder member is detachably inserted through a hole formed on a side wall of the process cartridge case so that the rotary member is supported by the distal end of the holder means.

Preferably, the rotary member is a charging roller and the holder means urges the charging roller toward a photoconductive roller provided in the process cartridge case.

Yet further, a fifth aspect of the present invention provides a process cartridge comprising a process cartridge case including a toner hopper storing toner. An agitator has an agitator shaft extending beyond a side wall of the process cartridge case and protruding in a cantilever fashion. A box is formed integrally with the side wall of the process cartridge case and surrounding an extended end of the agitator shaft. The box has an inner cylindrical surface and an annular ridge defining an opening having a diameter smaller than that of the inner cylindrical surface. An elastic member is accommodated in the box. A bearing member is inserted in the box and held by the annular ridge for rotatably supporting the agitator shaft. And, the bearing member has at least one deformable hook integrally formed and engaged with the annular ridge for locking the bearing member with the box. The bearing member compresses the elastic member when the bearing member is installed in position inside the box so that an inside space of the box is hermetically sealed by the elastic member.

BRIEF DESCRIPTION OF THE DRAWINGS

The above and other objects, features and advantages of the present invention will become more apparent from the following detailed description which is to be read in conjunction with the accompanying drawings, in which:

FIGS. 11A to 11C are views schematically showing the drum holder used in the process cartridge in accordance with the preferred embodiment of the present invention, wherein FIG. 11A is a front view, FIG. 11B is a side view and FIG. 11C is a cross-sectional view taken along a line B—B;

DESCRIPTION OF A PREFERRED EMBODIMENT

A preferred embodiment of the present invention will be explained hereinafter with reference to accompanied drawings.

Figure 1:
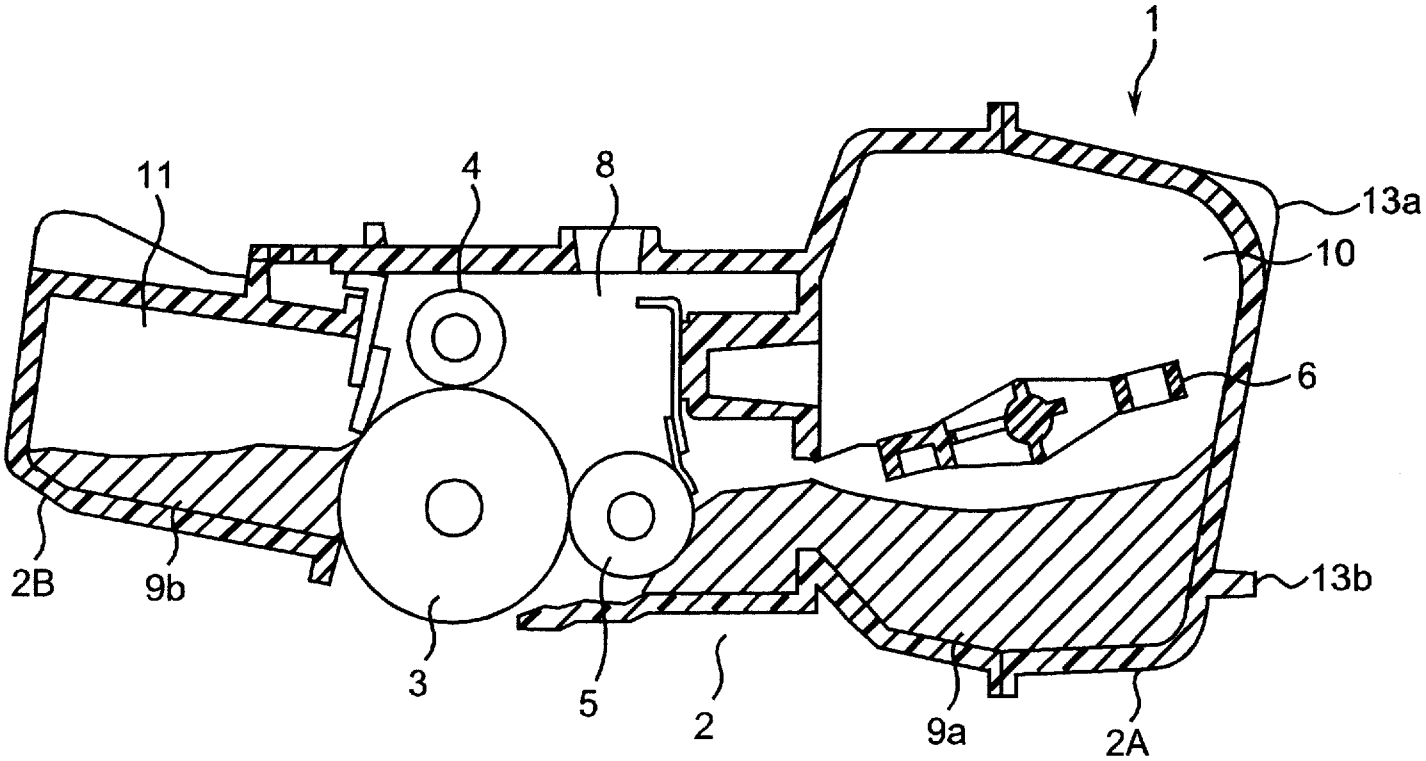
FIG. 1 is a cross-sectional view schematically showing a process cartridge in accordance with a preferred embodiment of the present invention.
Figure 2:
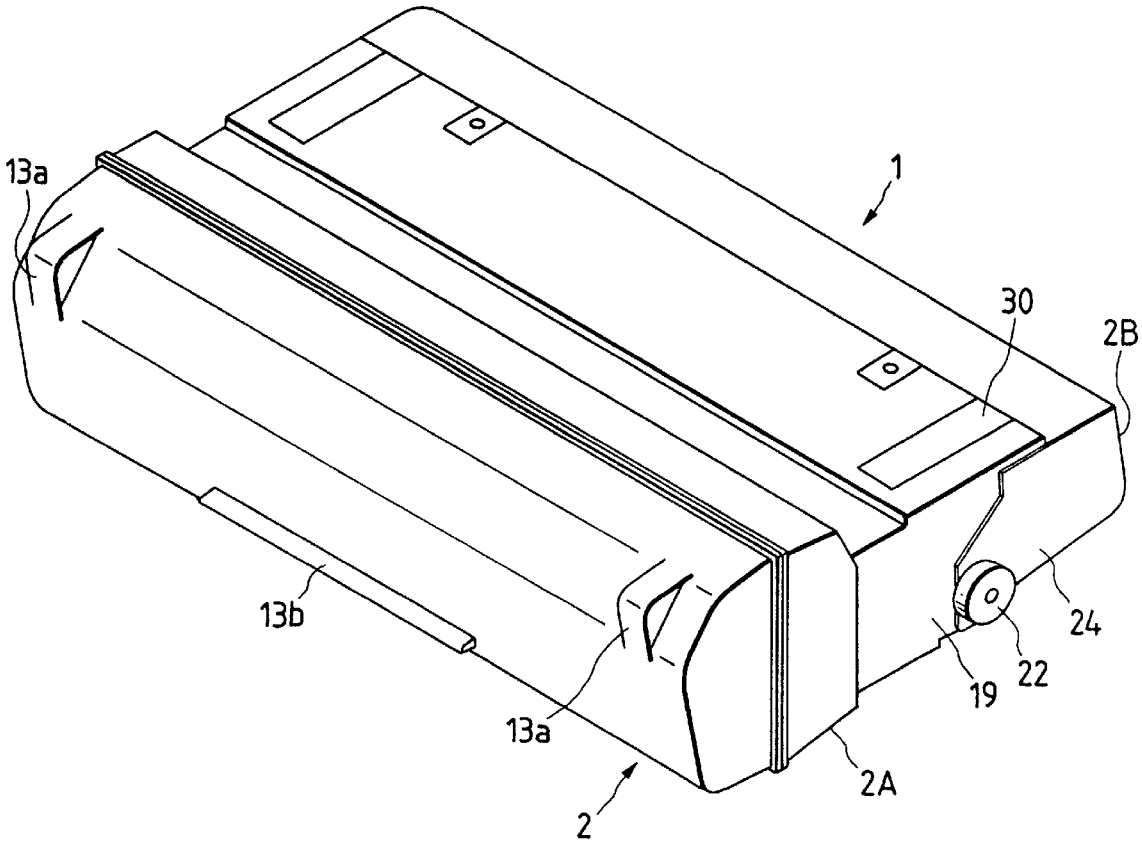
FIG. 2 is a perspective view schematically showing the process cartridge shown in FIG. 1.
Figure 3:
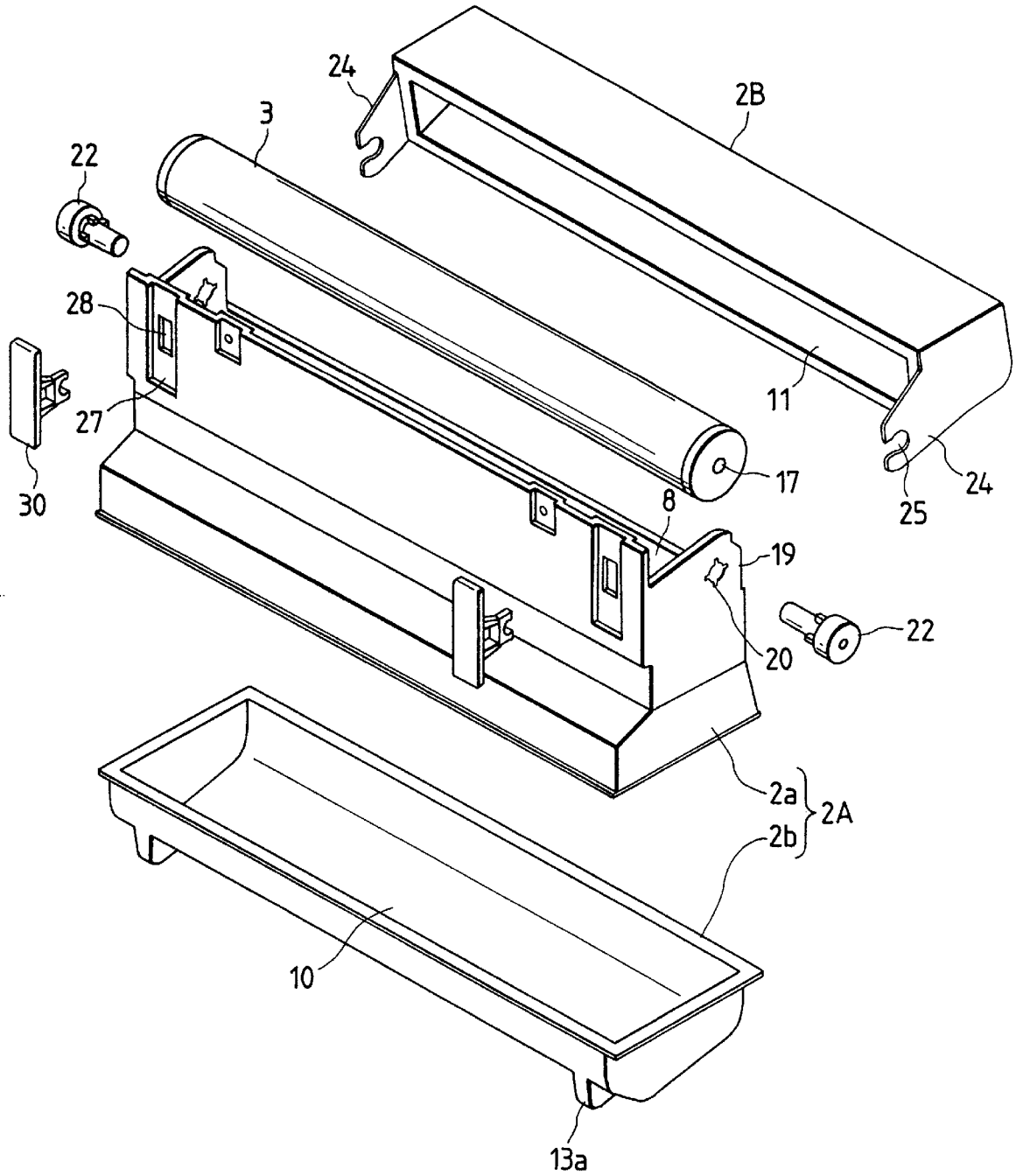
FIG. 3 is an exploded perspective view schematically showing the process cartridge shown in FIG. 1.

FIG. 1 is a cross-sectional view schematically showing a process cartridge in accordance with a preferred embodiment of the present invention. FIG. 2 is a perspective view schematically showing the process cartridge shown in FIG. 1. FIG. 3 is an exploded perspective view schematically showing the process cartridge shown in FIG. 1. A process cartridge, generally denoted by reference numeral 1, comprises a process cartridge case 2 accommodating a photoconductive drum 3, a charging roller 4, a developing roller 5, agitator 6 and others. The photoconductive drum 3 forms a latent image using a laser beam emitted from an optical scanning unit (not shown). The charging roller 4 is used to uniformly charge the photoconductive surface of the photoconductive drum 3. The developing roller 5 applies toner to the latent image formed on the photoconductive drum 3.

The process cartridge case 2, which is a resin product, has a drum housing 8 for accommodating the photoconductive drum 3, charging roller 4 and developing roller 5 therein, as shown in FIG. 1. The drum housing 8 is interposed between a toner hopper 10 storing fresh or unused toner 9*a* and a discharged toner box 11 collecting used toner 9*b*. A cross section of process cartridge case 2, taken along a plane perpendicular to the axis of photoconductive drum 3, is an elongated or thin configuration.

The process cartridge case 2 consists of a first part 2A and a second part 2B separable along a border in the region of the drum housing 8. Thus, the drum housing 8 can be opened by separating the second part 2B from the first part 2A. Thus, the photoconductive drum 3, charging roller 4 and others can be removed or taken out of the process cartridge case 2.

More specifically, the first part 2A has a configuration corresponding to the drum housing 8 and toner hopper 10.

As clearly understood from FIG. 3, first part 2A comprises a main frame 2*a* defining the drum housing 8 and part of toner hopper 10 and a toner hopper cover 2*b* defining the remainder of toner hopper 10. The main frame 2*a* and toner hopper cover 2*b* are molded independently and thereafter united into first part 2A through appropriate melting processing. On the other hand, second part 2B has a configuration corresponding to the discharged toner box 11.

Figure 4:
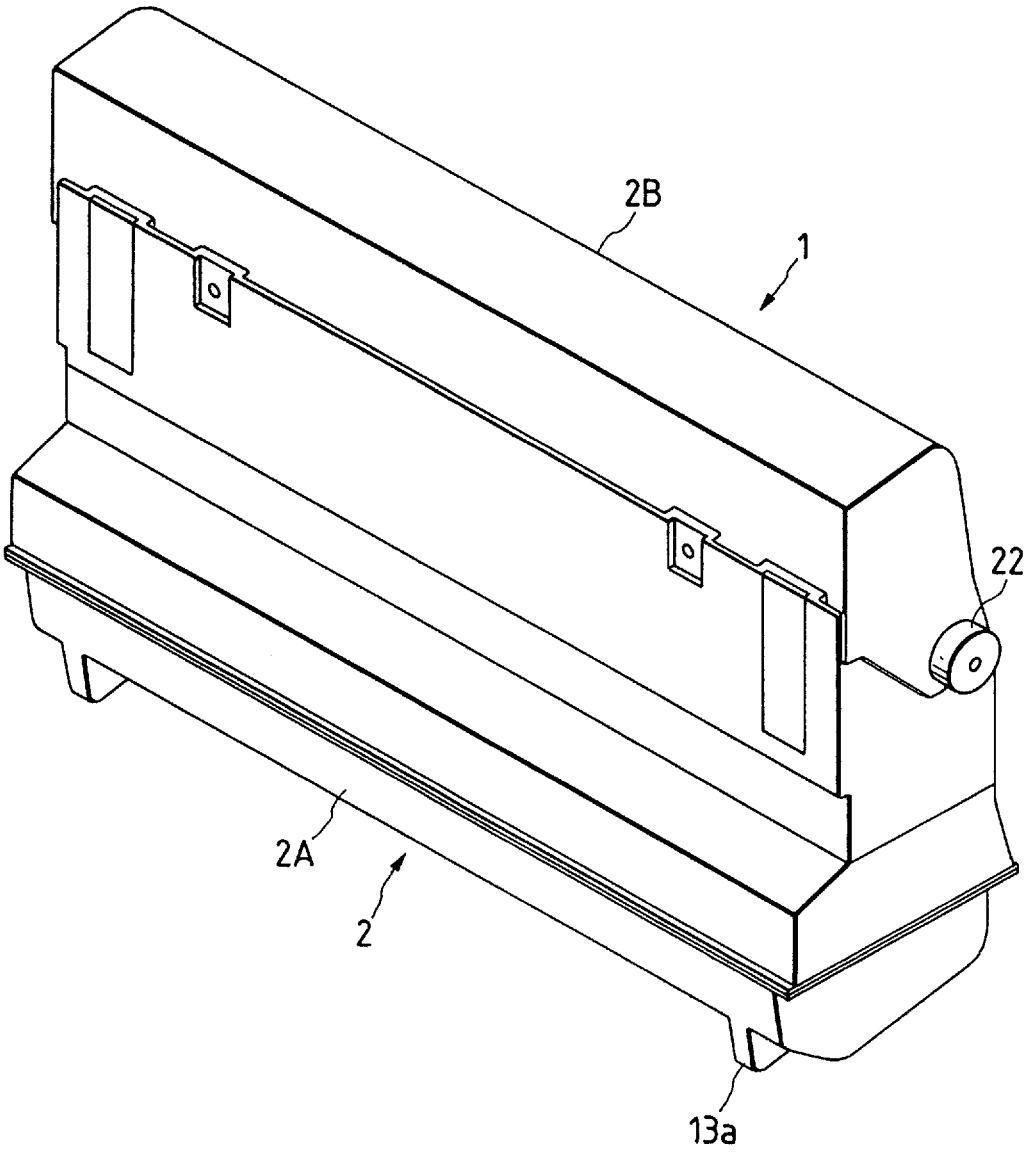
FIG. 4 is a perspective view schematically showing the process cartridge placed upright in accordance with the preferred embodiment of the present invention.
Figure 5:
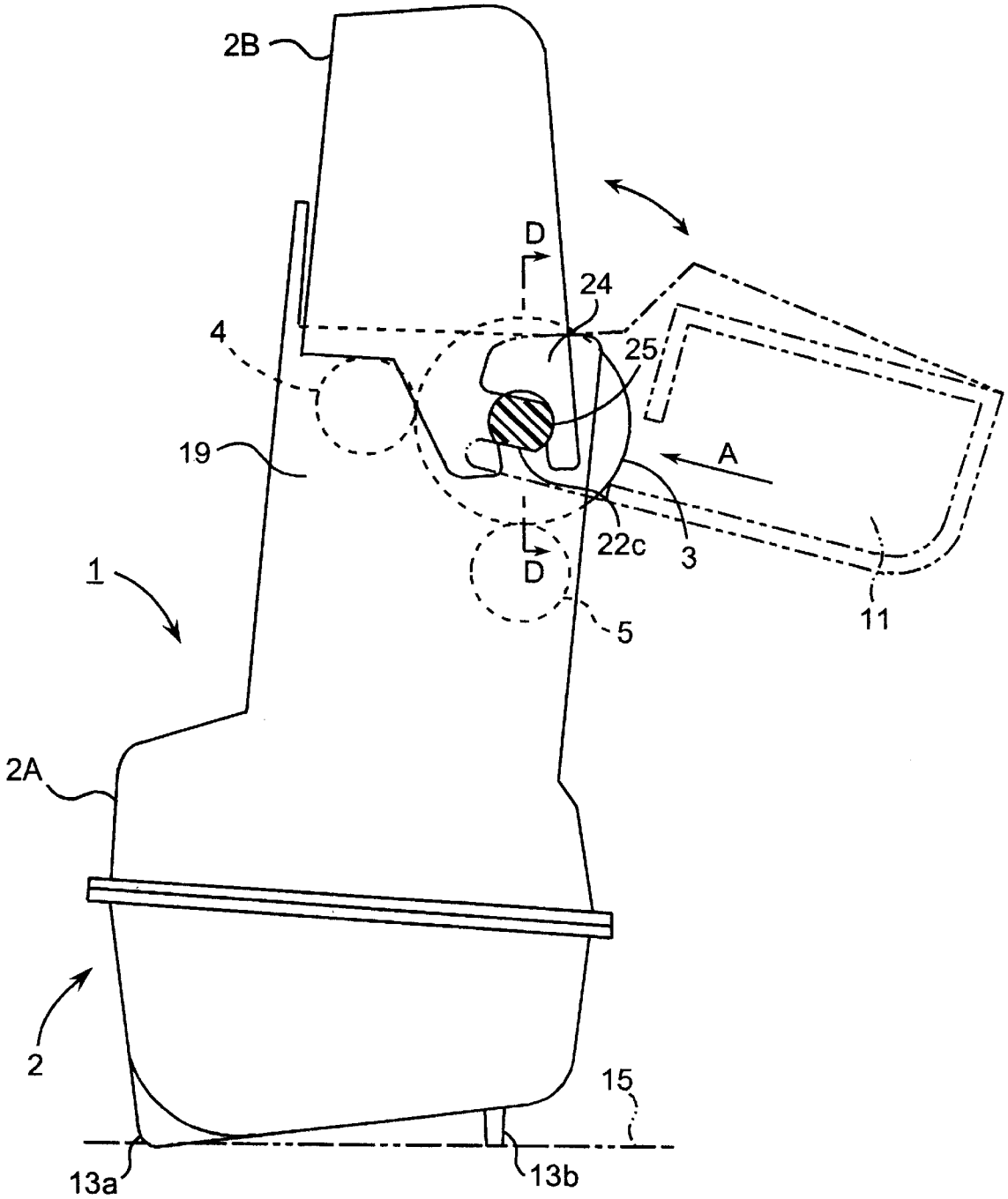
FIG. 5 is a side view schematically showing the process cartridge placed upright but showing only a drum holder is shown as a cross section at a second-part holder shaft thereof in accordance with the preferred embodiment of the present invention.
Figure 6:
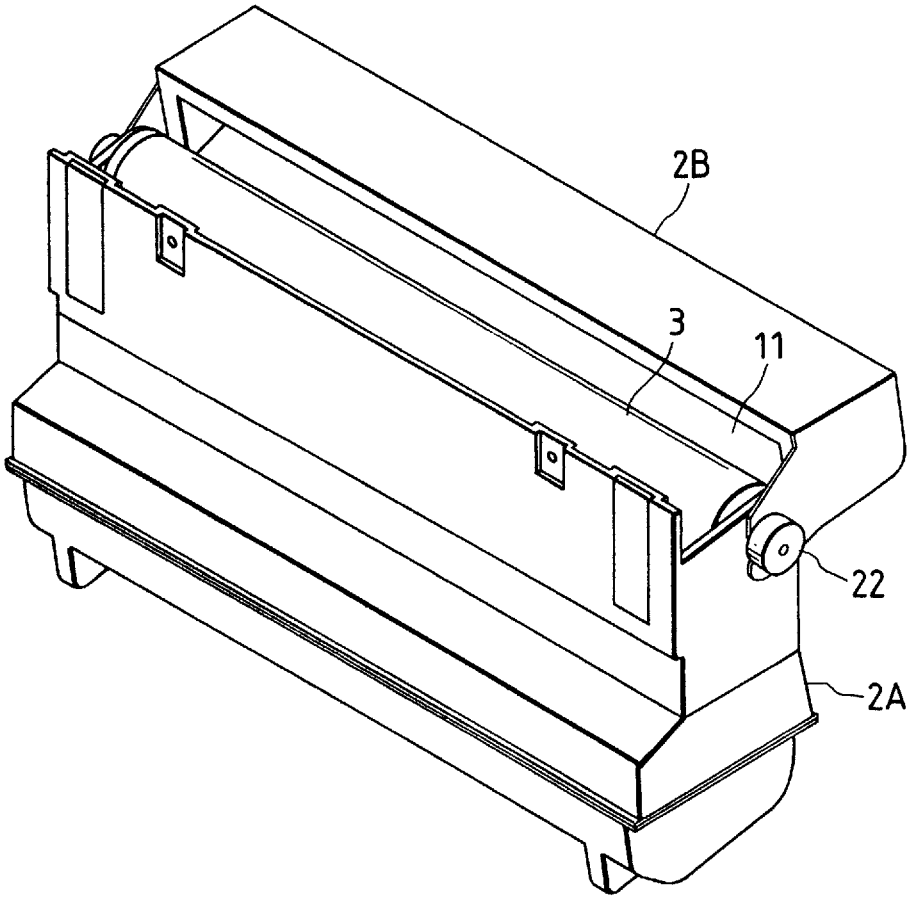
FIG. 6 is a perspective view schematically showing a condition where the second part is opened in accordance with the preferred embodiment of the present invention.

A pair of legs 13*a* and 13*b* are integrally formed on an outer surface of toner hopper cover 2*b* of process cartridge case 2. As shown in FIGS. 4 and 5, process cartridge case 2 can stand straight on these legs 13*a* and 13*b*. In this standing position, toner hopper 10 is bottomed and positioned adjacent to a flat horizontal plane 15 serving as a working table. The discharged toner box 11 is topped and positioned far from the plane 15. The process cartridge case 2 is held upright (i.e., at its standing position) for disassembling the parts accommodated in the process cartridge case 2 successively from the upper part to the lower part thereof or assembling the same parts in an opposite order. This is effective to prevent the toner stored in the toner hopper 10 from leaking. Needless to say, providing these legs 13*a* and 13*b* is advantageous to stabilize the upright position of the process cartridge 1 and to expedite the disassembling and assembling operations.

Figure 10:
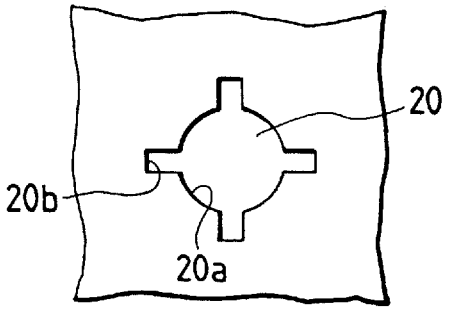
FIG. 10 is a side show showing a detailed configuration of a support hole opened on the side plate of the first part constituting the process cartridge of the preferred embodiment of the present invention.

In FIGS. 1 through 3, the photoconductive drum 3 has bearing holes 17 at the center of each axial end surface thereof. The first part 2A has opposed side plates 19 that define the side walls of the drum housing 8. Each side plate 19 has a support hole 20 formed at a position corresponding to the axial end surface of the photoconductive drum 3 when the drum 3 is placed in position inside the process cartridge case 2. A dram holder 22 is detachably inserted into each support hole 20 from the outside and held to support the corresponding axial end of photoconductive drum 3. As enlargedly shown in FIG. 10, a plurality of stopper grooves 20*b* are formed at equal intervals along a circular periphery of a round hole 20*a*. Among plurality of stopper grooves 20*b* only one groove 20*b* is shorter than the remainder, so that an angular position of drum holder 22 can be regulated by this short groove 20*b* when the drum holder 22 is inserted in the support hole 20 (refer to FIGS. 11A to 11C).

Figure 11A:
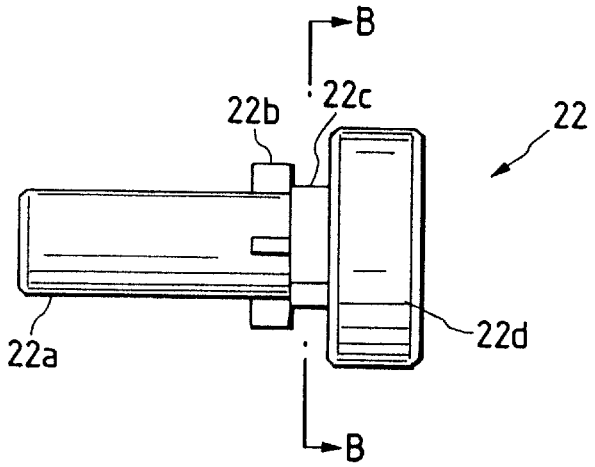
Figure 11B:
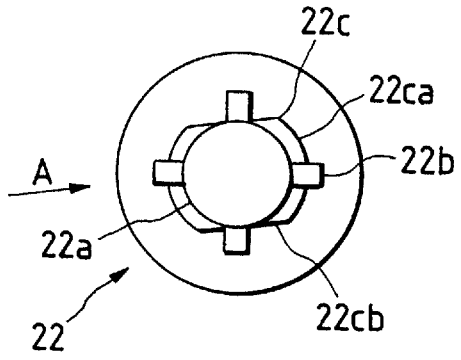
Figure 11C:
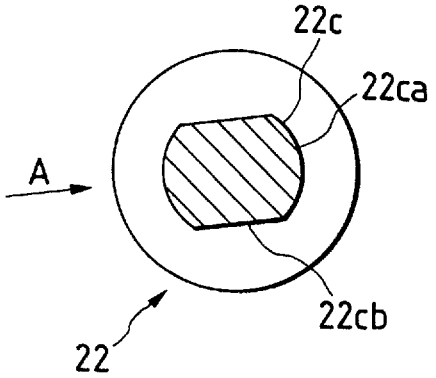

The drum holder 22, as enlargedly shown in FIGS. 11A to 11C, comprises a drum holder shaft 22*a* inserted into a bearing hole 17 of the photoconductive drum 3, a coupling portion 22*b* coupled with the support hole 20 on the side plate 19, a second-part holder shaft 22*c* having a radial size smaller than the maximum radial size of the coupling portion 22*b*, and a grip portion 22*d* having a diameter larger than that of the second-part holder shaft 22*c*. The photoconductive drum 3 is rotatable about drum holder shaft 22*a*.

More specifically, coupling portion 22*b* has a cross section substantially identical to or fitting to the support hole 20. A plurality of protrusions, formed at equal intervals along a cylindrical surface, correspond to the stopper grooves 20*b* of support hole 20. An axial length of coupling portion 22*b* is slightly larger than the thickness of side plate 19 of first part 2A. The second-part holder shaft 22*c* comprises opposed cylindrical surfaces 22*ca* and parallel flat surfaces 22*cb* interposed between the cylindrical surfaces 22*ca*. In a cross section of second-part holder shaft 22*c* normal to the axis thereof, two arcs of second-part holder shaft 22*c* corresponds to the cylindrical surfaces 22*ca* while two chords of second-part holder shaft 22*c* corresponds to the parallel flat surfaces 22*cb*.

As shown in FIG. 11B, the diameter of second-part holder shaft 22*c*, (i.e., the diameter of the cylindrical surfaces 22*ca*) is larger than the diameter of the drum holder shaft 22*a* (i.e., the cylindrical surface of the coupling portion 22*b*). In other word, the thickness of the second-part holder shaft 22*c* is smallest when seen from the direction parallel to the flat surfaces 22*cb* shown by an arrow"A." An axial length (i.e., width) of second-part holder shaft 22*c* is slightly larger than the thickness of a connecting portion 24 (refer to FIG. 3) formed at each axial end of the second part 2B.

Figure 12:
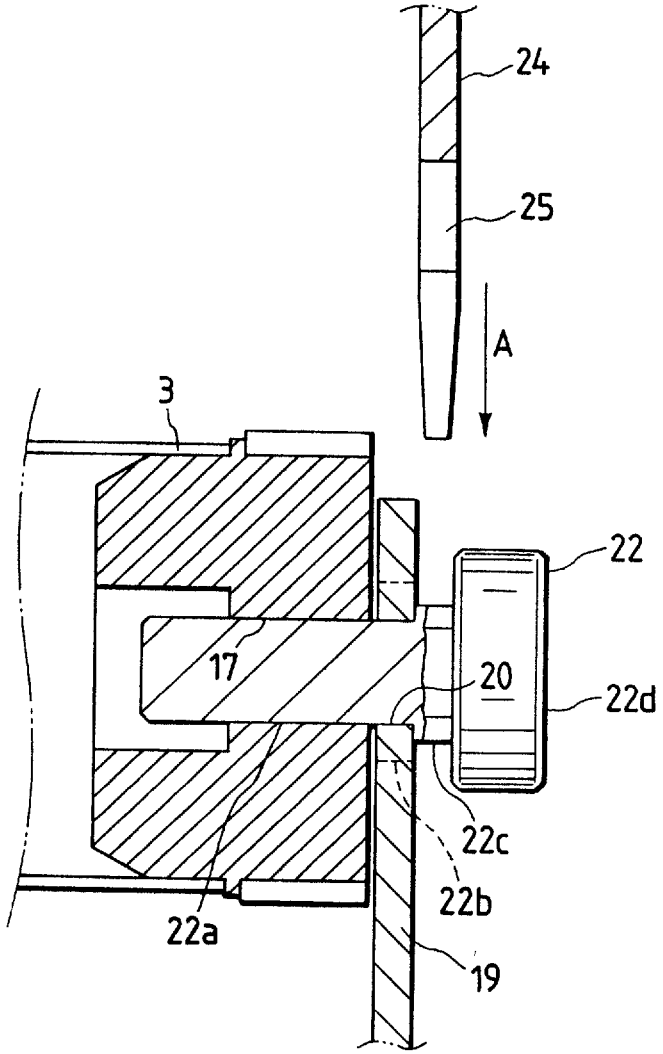
FIG. 12 is a cross-sectional view taken along a line C—C of FIG. 7.

FIG. 12 shows a condition where drum holder 22 is inserted into the support hole 20 of side plate 19 from the outside until the second-part holder shaft 22*c* abuts the outer surface of the side plate 19. Thus, the drum holder 22 is held firmly not to rotate against the side plate 19. The distal end of drum holder shaft 22*a* is inserted into the bearing hole 17 of the photoconductive drum 3. The photoconductive drum 3 is thus rotatable about the drum holder shaft 22*a*.

In the condition shown in FIG. 12, the second-part holder shaft 22*c* of the drum holder 22 is exposed outside the side plate 19. Accordingly, by shifting the connecting portion 24 in the direction of arrow A, the connecting portion 24 can be smoothly inserted between the side plate 19 and the grip portion 22*d* and finally coupled with the second-part holder shaft 22*c*.

As shown in FIG. 3, connecting portions 24 are formed at the axial ends of the second part 2B in an opposed and parallel relationship. An axial or longitudinal clearance between inner surfaces of the pair of connecting portions 24 is substantially the same as that of the outer surfaces of the pair of side plates 19 of the first part 2A. Therefore, the pair of connecting portions 24 can be slid along the outer surfaces of the pair of side plates 19, so that they are overlapped partly. A bearing groove 25 is formed on the distal end of each connecting portion 24, so that this bearing groove 25 is engaged with the second-part holder shaft 22*c* of drum holder 22.

Figure 7:
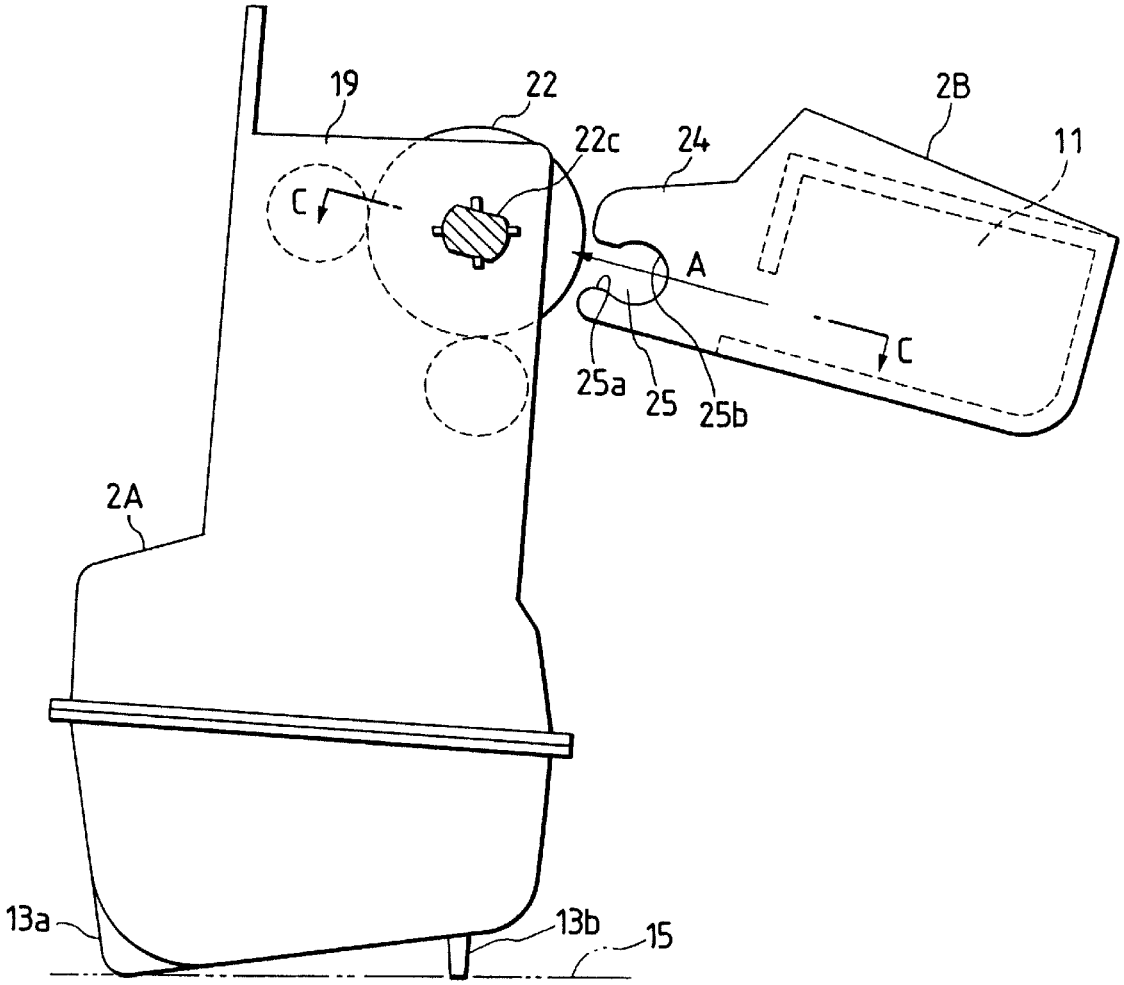
FIG. 7 is a side view similar to FIG. 5 but showing another condition where the second part is removed from a first part in accordance with the preferred embodiment of the present invention.

As shown in FIG. 7, the bearing groove 25 consists of an outer groove 25*a* and an inner groove 25*b*. The outer groove 25*a* is necked at its opened end with a width narrower than the diameter of a circle of inner groove 25*b*. The outer opened groove 25*a* has a size slightly larger than the gap between two flat parallel surfaces 22*cd* of second-part holder shaft 22*c* of drum holder 22. The inner circular groove 25*b* is coupled with the cylindrical surface of second-part holder shaft 22*c*. The second part 2B is rotatable about the cylindrical surface of second-part holder shaft 22*c*.

Thus, as shown in FIGS. 7 and 12, the drum holder 22 is inserted and held in the support hole 20 (refer to FIG. 3) formed on each side plate 19 of first part 2A. In this holding condition, the symmetrical axis of bearing groove 25, connecting the center of inner circular groove 25*b* and the center of the outer opened groove 25*a*, is aligned along the direction of arrow"A." When the second part 2B is shifted along the arrow"A," the outer opened groove 25*a* advances toward the narrow gap between two flat parallel surfaces 22*cd* of second-part holder shaft 22*c* of drum holder 22. In other words, the second part 2B can be engaged with or disengaged from first part 2A only when the second part 2B is shifted along the direction of arrow"A."

Figure 13:
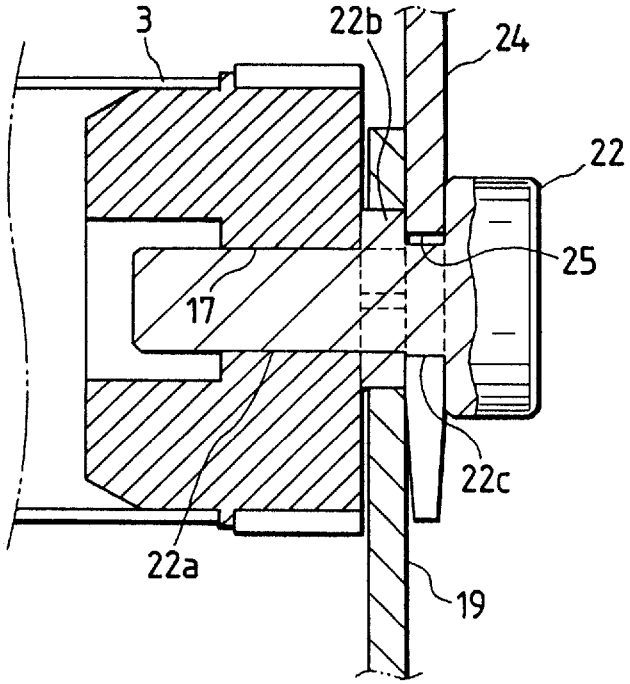
FIG. 13 is a cross-sectional view taken along a line D—D of FIG. 5.

After coupling the bearing groove 25 with the second-part holder shaft 22*c*, the second part 2B is rotated about the second-part holder shaft 22*c* from an opened position to a closed position. Thus, the second part 2B is closed with respect to the first part 2A as shown in FIGS. 1 and 5. In this closed condition, as shown in FIG. 13, the bearing groove 25 of connecting portion 24 of second part 2B is coupled with the second-part holder shaft 22*c* of drum holder 22. The protrusions of coupling portion 22*b* abut the inside surface of the connecting portion 24. Thus, drum holder 22 is firmly locked and cannot be pulled out of the bearing groove 25 of the connecting portion 24. Although not shown in FIGS. 1 and 5, there is provided an appropriate fixing mechanism, such as a fastening bolt mechanism or a latch mechanism (both not shown), for firmly fixing the second part 2B at the closed position with respect to the first part 2A.

As clearly understood from FIG. 7, when the second part 2B is located at its opened position. The symmetrical axis of the bearing groove 25 is aligned along the arrow"A". In this condition, an opening or inlet of the discharged toner box 11 can be directed upward obliquely along the arrow "A". Meanwhile, the first part 2A is held upright (i.e., at a standing position). The direction of parallel flat surfaces 22*cb* becomes identical with the arrow "A" in the condition shown in FIG. 7. Directing the opening or inlet of the discharged toner box 11 upward obliquely during an engaging/disengaging (or assembling/removal) operation is advantageous to prevent the used toner 9*b* from falling out of the discharged toner box 11.

Figure 14:
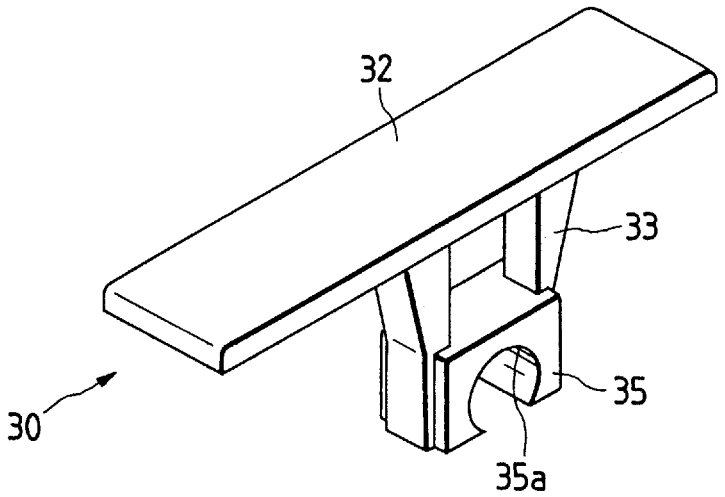
FIG. 14 is a perspective view schematically showing a charging roller holder used in the process cartridge in accordance with the preferred embodiment of the present invention.

As shown in FIG. 3, a pair of shallow grooves 27 are formed on an axially extending wall of the first part 2A of the process cartridge 2 at a portion adjacent to the side plate 19. A hole 28 is opened at the center of this shallow groove 27. A charging roller holder 30 is detachably inserted in each hole 28. The charging roller holder 30 serves as a means for rotatably holding the charging roller 4 and pressing the charging roller 4 against the photoconductive drum 3 (refer to FIG. 1). An arrangement of charging roller holder 30 is shown in greater detail in FIGS. 14 and 15. The charging roller holder 30 comprises a flat plate portion 32 engaged with the shallow groove 27, a pair of guide portions 33 protruding from the flat plate portion 32 and extending through the hole 28 inside the process cartridge case 2, spring portions 34 formed integrally on opposed outer side walls of the guide portions 33, a holder portion 35 slidably held by the pair of guide portions 33, and a coil spring 36 pushing the holder portion 35. When the flat plate portion 32 is engaged with the shallow groove 27, an outer surface of plate portion 32 is flush with the surface of the process cartridge case 2. The spring portions 34 are deformed inward during an inserting operation of the guide portions 33 into the hole 28 and sprung back outward to serve as a stopper when the guide portions 33 are completely inserted in position. The holder portion 35 has a bearing surface 35*a* for rotatably supporting the shaft 4*a* of the charging roller 4. The holder portion 35 is opened with a clearance slightly narrower than the diameter of the shaft 4*a*. Thus, the shaft 4*a* can be forcibly pushed into or pulled out of the holder portion 35 by elastically deforming the opened edges of holder portion 35. An urging force given from the coil spring 36 to the holder portion 35 is used for always pressing the charging roller 4 toward the photoconductive drum 3.

Figure 15:
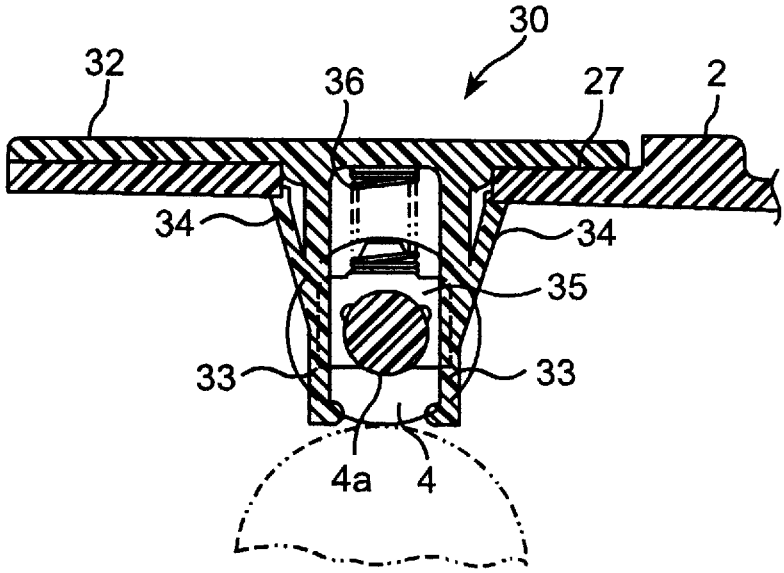
FIG. 15 is an enlarged cross-sectional view showing a detained arrangement of the charging roller holder in an assembled condition in accordance with the preferred embodiment of the present invention.

The charging roller holder 30 is usually attached on the process cartridge case 2 as shown in FIG. 15. When charging roller 4 is removed from the process cartridge case 2 for cleaning or maintenance, the shaft 4*a* of charging roller 4 is detached from the holder portion 35. During the removal or reinstallation of the charging roller 4, there is a possibility that the guide portion 33 may be damaged by an impact force accidentally applied on the guide portion 33 because of a protruding configuration of guide portion 33. In such a case, only a necessary thing is to remove the broken roller holder 30 from the process cartridge case 2 and replace it by a new one. In other words, the process cartridge case 2 itself needs not be replaced by a new one. Accordingly, there is no necessity of wasting the entire body of process cartridge case 2.

Figure 16:
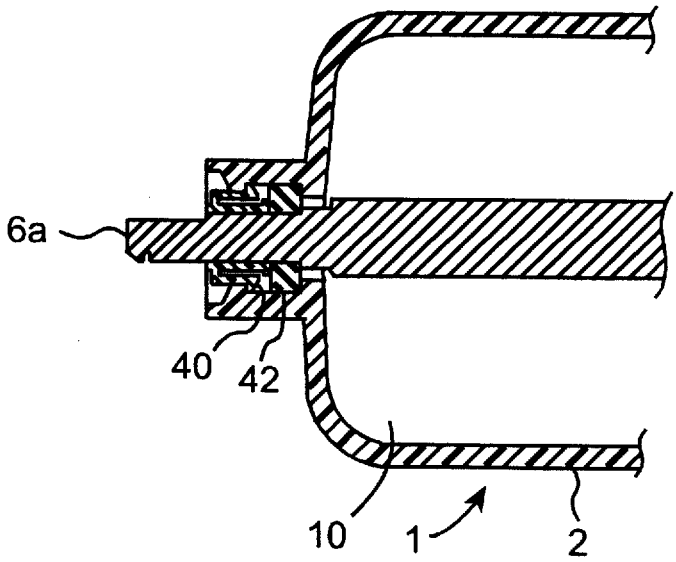
FIG. 16 is an enlarged cross-sectional view showing a detailed arrangement of one end portion of a toner hopper of the process cartridge in accordance with the preferred embodiment of the present invention.
Figure 17:
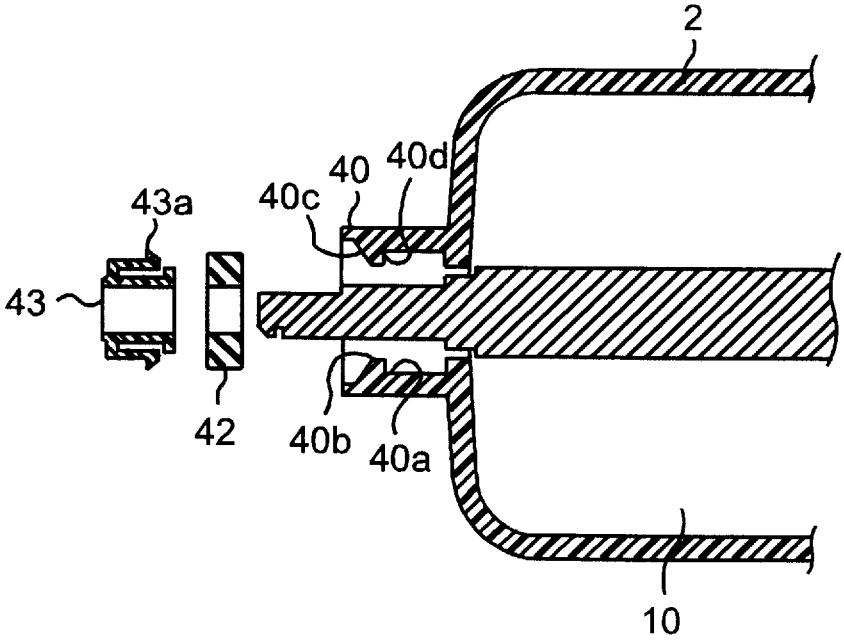
FIG. 17 is an exploded view showing each component shown in FIG. 16.
Figure 18:
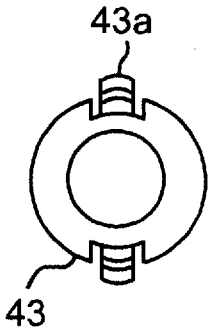
FIG. 18 is an enlarged side view showing a bearing member shown in FIG. 17.

FIG. 16 is an enlarged cross-sectional view showing a detailed arrangement of one end portion of the toner hopper 10 of the process cartridge 1. FIG. 17 is an exploded view showing each component shown in FIG. 16. FIG. 18 is an enlarged side view showing a bearing member shown in FIG. 17. The agitator 6 comprises an agitator shaft 6*a* having one end extending in an axial direction beyond the side wall of process cartridge case 2 and protruding in a cantilever fashion. A box 40, surrounding the extended end of agitator shaft 6*a*, is integrally formed with the side wall of process cartridge case 2. The box 40 comprises an inner cylindrical surface 40*a* at a position adjacent to the toner hopper 10. Provided outside the inner cylindrical surface 40*a* is an annular ridge 40*b* defining an opening whose diameter is smaller than the diameter of inner cylindrical surface 40*a*. The outside surface of the annual ridge 40*b* is formed into a tapered surface 40*c*, while the inside surface of the annual ridge 40*b* is formed into a vertical or perpendicular surface 40*d*.

An elastic member 42, such as sponge, is disposed inside the box 40 so as to surround the agitator shaft 6*a*. A bearing member 43, rotatably supporting the agitator shaft 6*a*, is inserted into the box 40 and held by the annular ridge 40*b*. The bearing member 43 has hooks 43*a* disposed at equal angular intervals and integrally formed on the outer surface thereof. The hooks 43*a* are engaged with the inside vertical surface 40*d* of the annular ridge 40*b* to lock the bearing member 43 with box 40. When the bearing member 43 is installed in position inside the box 40, the elastic member 42 is compressed by the bearing member 43 so that the inside space of box 40 is hermetically sealed by the elastic member 42. In other words, under an assembled condition shown in FIG. 16, the bearing member 43 functions as a means for rotatably supporting the agitator shaft 6*a*while the elastic member 42 functions as a member preventing the toner 9*a* from leaking out of the toner hopper 10. When the elastic member 42 needs to be exchanged, the bearing member 43 is removed from the box 40 by pinching the hooks 43*a* radially inward. Thus, the exchanging operation for the elastic member 42 is expedited.

A method of using the process cartridge 1 having the above-described arrangement will be explained hereinafter.

For an ordinary operation, the process cartridge 1 is assembled in a condition shown in FIGS. 1 and 2. The process cartridge 1 is installed and used, in this condition, into an associated electrophotographic apparatus, such as a facsimile machine, a laser printer, a copy machine or the like. After completing the life, the process cartridge 1 is collected from each user and sent to a reproduction facility to fix or refill for reuse.

Figure 8:
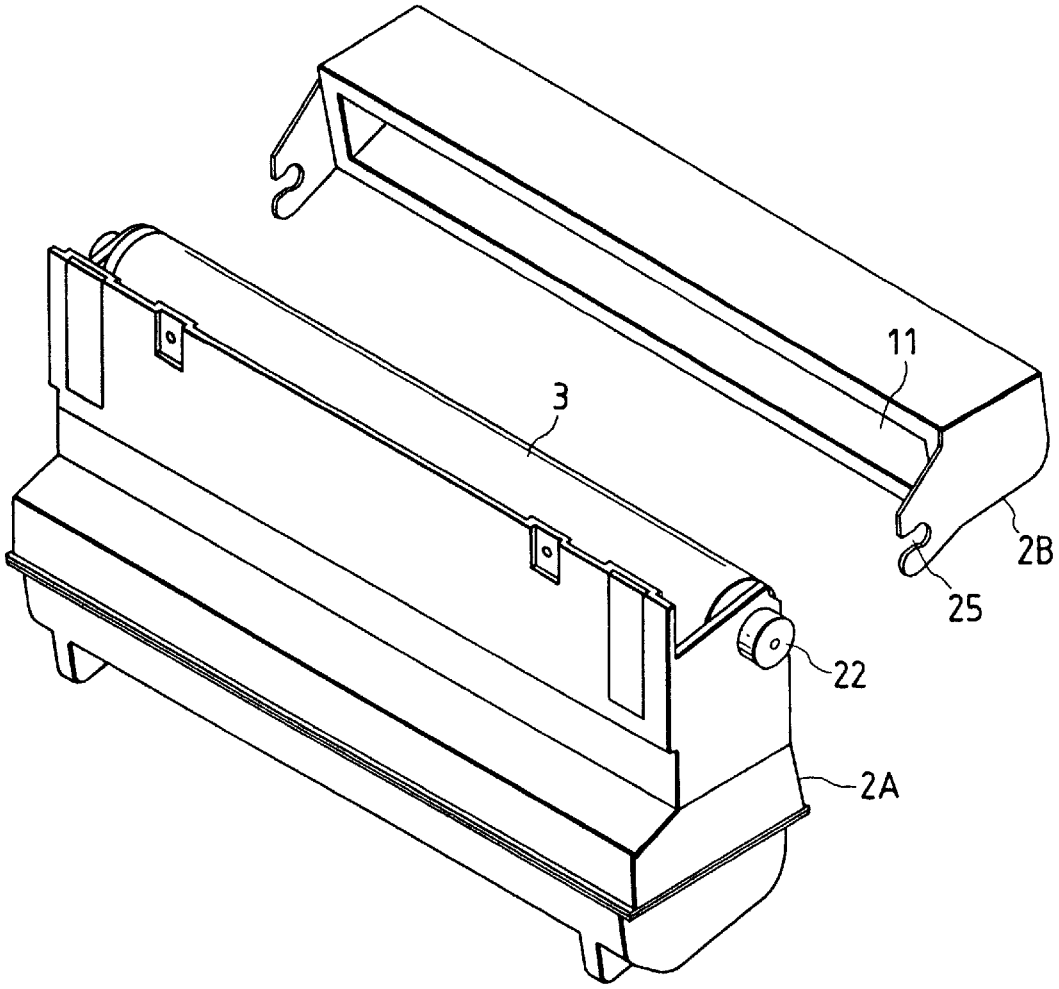
FIG. 8 is a perspective view similar to FIG. 6 but schematically showing another condition where the second part is removed from the first part in accordance with the preferred embodiment of the present invention.

More specifically, as shown in FIGS. 4 and 5, in the reproduction facility the process cartridge 1 is placed upright on a horizontal plane 15 of a working table. Next, the second part 2B, located at an upper position, is rotated or swung about the drum holder 22, until the second part 2B is angularly placed at a removable or opened position (indicated by an alternate long and two short dashes line in FIG. 5) where each flat surface 22*cb* of second-part holder shaft 22*c* of drum holder 22 is aligned along the allow"A" directing upward obliquely. Then, the second part 2B is pulled out in the direction opposed to the arrow"A." Thus, the second part 2B is removed from the drum holder 22 of first part 2A and the upper part of the drum housing 8 of the process cartridge case 2 is opened as shown in FIGS. 7 and 8. In this opened condition, the inlet or opening of the discharged toner box 11 of second part 2B is directed upward obliquely. Thus, the used toner 9*b* is surely held in the discharged toner box 11 without being overflowed therefrom. Accordingly, the peripheral parts or neighboring circumstances are surely prevented from being contaminated by the leaked toner during a disassembling of the process cartridge.

Figure 9:
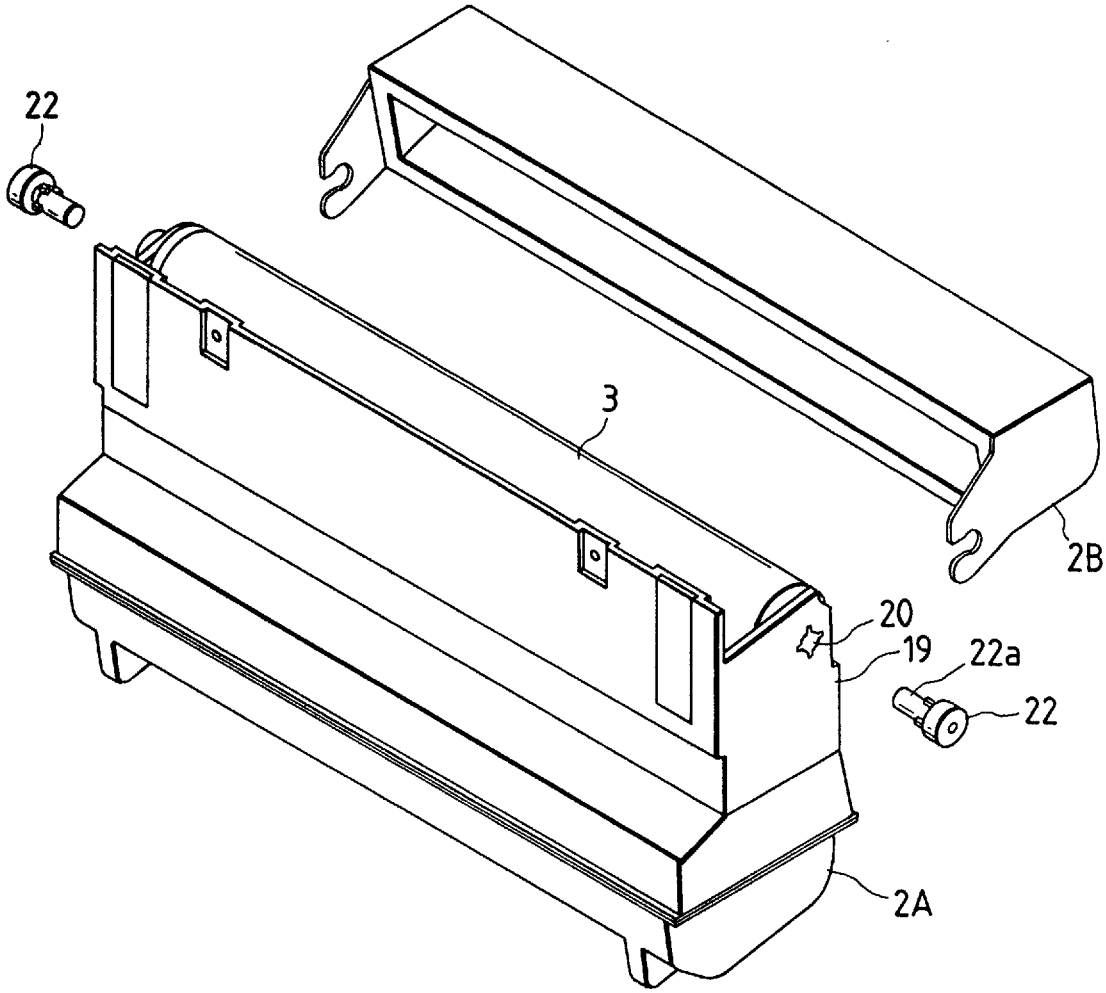
FIG. 9 is a perspective view similar to FIG. 6 but schematically showing still another condition where both of the second part and associated drum holders are removed from the first part in accordance with the preferred embodiment of the present invention.

Next, as shown in FIG. 9, both of the drum holders 22 are pulled out of the support holes 20 on the side plates 19 of the first part 2A to release or disengage the photoconductive drum 3 from the second part 2A. Thereafter, the discharging roller 4 and the developing roller 5 are successively removed. The removing operation for these components 22, 3, 4, and 5 is done easily because the first part 2A is placed at an upright or standing position. No toner is leaked from the toner hopper 10.

After the components of the process partridge 1 are completely disassembled, the toner remaining in the first part 2A and second part 2B is discharged. Then, each inside space of the first part 2A and second part 2B is cleaned. The condition of every disassembled part is checked. And, a damaged or defective part is replaced by a new one. Subsequently, the toner hopper 10 is refilled with fresh toner.

Next, the components are reassembled under the condition where the first part 2A is held upright. That is, as shown in FIG. 9, the developing roller 5 and the discharging roller 4 are set in position inside the first part 2A held upright, while the drum holders 22 are inserted into the support holes 20 of side plates 19. The drum holder shaft 22*a* is inserted into the bearing hole 17 of photoconductive drum 3. Thus, the photoconductive drum 3 is rotatably supported by the drum holder 22.

Next, the second part 2B is set to the position shown in FIG. 7. The symmetrical axis of bearing groove 25, connecting the opening center of outer groove 25*a* and the center of inner circular groove 25*b*, coincides with the direction of arrow"A". Thus, by shifting the second part 2B along the arrow "A", the bearing groove 25 is engaged with the second-part holder shaft 22*c*. Namely, the leading side of bearing groove 25, i.e., outer opened groove 25*a*, advances toward the narrow gap between two flat parallel surfaces 22*cd* of second-part holder shaft 22*c* of drum holder 22. Then, after the outer opened groove 25*a* passed through the two flat parallel surfaces 22*cd*, the inner circular groove 25*b* is coupled with the second-part holder shaft 22*c*.

Then, the second part 2*b* is rotated about the second-part holder shaft 22*c* upward until the second part 2B returns to the ordinary or closed (home) position shown in FIG. 4. Thereafter, the second part 2B is fixed with the first part 2A by appropriate fastening means such as screws (not shown). In this manner, the process cartridge 1 is reassembled for reuse.

As apparent from the foregoing description, according to the preferred embodiment of the present invention, a process cartridge comprises a photoconductive drum disposed in a drum housing formed in a process cartridge case. A toner hopper and a discharged toner box are formed in the process cartridge case, so that the drum housing is interposed between the toner hopper and the discharged toner box. At least one leg is provided on an outer surface of the process cartridge case at a region corresponding to the toner hopper, so that the process cartridge case is held upright by the leg. And, the process cartridge case comprises a plurality of parts separable along a border in a region of the drum housing.

With this arrangement, during a disassembling operation, the process cartridge can be held in an upright position where the toner hopper is bottomed and the discharged toner box is topped. The parts, such as a photoconductive drum and a discharging roller, can be removed from the opened upper part of the process cartridge case held upright. This expedites the disassembling operation and effective to prevent the toner from leaking out of the toner hopper. The assembling operation is also easily done under the condition where the process cartridge case is held upright. Thus, it becomes possible to provide an excellent refillable process cartridge easily disassembled and reassembled for reproduction.

Preferably, the process cartridge case is opened by removing the discharged toner box.

Furthermore, according to the preferred embodiment of the present invention, the process cartridge case is separable into a first part and a second part along a border in a region of the drum housing. A drum holder is provided detachably for engaging the photoconductive drum with the process cartridge case. The first part has a side plate with a support hole opened at a position corresponding to an axial end of the photoconductive drum. The support hole including a stopper. The drum holder comprises a drum holder shaft rotatably supporting the photoconductive drum, a coupling portion coupled with the support hole of the side plate of the first part, and a secondpart holder shaft having a radial size smaller than a maximum radial size of the coupling portion. The second part has a connecting portion with a bearing groove engageable with the second-part holder shaft of the drum holder, so that the second part is joined with the first part by coupling the bearing groove with the second-part holder shaft supported on the side plate of the first part, while the connecting portion of the second part prevents the drum holder from being pulled out in an axial direction.

With this arrangement, the structural relationship between the first and second parts of the process cartridge case and the consumable components, such as the photoconductive drum and the discharging roller, can be simplified. Thus, the disassembling and reassembling operations during a reproduction of the process cartridge can be facilitated.

Furthermore, according to the preferred embodiment of the present invention, a bearing hole is provided at each axial end of the photoconductive drum. The process cartridge case is separable into a first part and a second part along a border in a region of the drum housing. A drum holder is provided detachably with respect to the first part. The drum holder is provided for engaging the photoconductive drum with the process cartridge case. The first part has a toner hopper and a side plate with a support hole. The support hole of the side plate, including a stopper, is opened at a position corresponding to the axial end of the photoconductive drum. The drum holder comprises a drum holder shaft rotatably supporting the photoconductive drum, a coupling portion coupled with the support hole of the side plate of the first part, and a second-part holder shaft having a narrow width when seen from a specific angular direction. The second part has a discharged toner box and a connecting portion with a bearing groove necked at an open end and engageable with the second-part holder shaft of the drum holder. The second part is joined with the first part by coupling the bearing groove with the second-part holder shaft supported on the side plate of the first part. And, the second part is detachable from the first part only when the necked open end of the bearing groove faces toward the second-part holder shaft and moves in the specific angular direction. Thus, an inlet of the discharged toner box is directed upward obliquely when the second part is removed from the first part under a condition where the process cartridge case is placed upright with the toner hopper bottomed.

With this arrangement, it becomes possible to prevent the used toner from falling from the dischaged toner box. Neither peripheral parts nor the working place is contaminated by the toner during the disassembling or reassembling operation.

Still further, according to the preferred embodiment of the present invention, the process cartridge comprises the process cartridge case, a rotary member provided at a predetermined position in the process cartridge case, and a holder means for rotatably supporting an axial end of the rotary member. The holder member is detachably inserted through a hole formed on a side wall of the process cartridge case so that the rotary member is supported by the distal end of the holder means.

With this arrangement, it becomes possible to replace only the holder member with a new one in an event the holder member is damaged during the disassembling or reassembling operation.

Preferably, the rotary member is a charging roller and the holder means urges the charging roller toward a photoconductive roller provided in the process cartridge case.

Yet further, according to the preferred embodiment of the present invention, the toner hopper of the process cartridge comprises an agitator for agitating the toner stored in this toner hopper. The agitator has an agitator shaft extending beyond a side wall of the process cartridge case and protruding in a cantilever fashion. A box is formed integrally with the side wall of the process cartridge case and surrounding an extended end of the agitator shaft. The box has an inner cylindrical surface and an annular ridge defining an opening having a diameter smaller than that of the inner cylindrical surface. An elastic member is accommodated in the box. A bearing member is inserted in the box and held by the annular ridge for rotatably supporting the agitator shaft. And, the bearing member has at least one deformable hook integrally formed and engaged with the annular ridge for locking the bearing member with the box. The bearing member compresses the elastic member when the bearing member is installed in position inside the box so that an inside space of the box is hermetically sealed by the elastic member.

With this arrangement, it becomes possible to hermetically seal the clearance between the agitator shaft and the side wall of the toner hopper. And, the elastic member can be replaced with a new one. By unlocking the deformable hook from the annular ridge, the bearing member is easily removed from the box.

As this invention may be embodied in several forms without departing from the spirit of essential characteristics thereof, the present embodiment as described is therefore intended to be only illustrative and not restrictive, since the scope of the invention is defined by the appended claims rather than by the description preceding them, and all changes that fall within the metes and bounds of the claims, or equivalents of such metes and bounds, are therefore intended to be embraced by the claims.

What is claimed is:

1. A process cartridge comprising:

a photoconductive drum disposed in a drum-housing formed in a process cartridge case;

a toner hopper and a discharged toner box formed in said process cartridge case, so that said drum housing is interposed between said toner hopper and said discharged toner box; and at least one leg provided on an outer surface of said process cartridge case at a region corresponding to said toner hopper, so that said leg supports said process cartridge case in an upright condition where said discharged toner box is positioned at a top of said process cartridge case and said toner hopper is positioned at a bottom of said process cartridge case;

wherein said process cartridge case comprises a plurality of parts separable along a border in a region of said drum housing.

2. The process cartridge in accordance with claim 1, wherein said process cartridge case is opened by removing said discharged toner box.

3. A process cartridge comprising:

a process cartridge case having a drum housing accommodating a photoconductive drum and separable into a first part and a second part along a border in a region of said drum housing;

said first part having a side plate with a support hole opened at a position corresponding to an axial end of said photoconductive drum, said support hole having a plurality of stopper grooves formed along a circumferential periphery thereof:

said second part having platelike connecting portions extending from both ends thereof, each connecting portion having an opened bearing groove that is formed into a narrow groove at an opened end and a circular groove at a closed end, said circular groove being continuous with said narrow groove and having a diameter larger than a gap of said narrow groove; and a drum holder having a drum holder shaft, a coupling portion, a second-part holder shaft, and a grip portion integrally formed in this order from a front end to a base end thereof, said drum holder shaft being inserted into a bearing hole of said photoconductive drum for rotatable supporting said photoconductive drum;

said coupling portion having a cross-sectional shape similar to that of said support hole formed on said side plate of said first part, having a plurality of projections formed on a cylindrical surface thereof so as to be coupled with said stopper grooves of said support hole, said second-part holder shaft having a cylindrical body larger in diameter than said coupling portion, said cylindrical body having parallel flat faces formed along parallel chords in a circular cross section of said second-part holder shaft;

wherein, in a condition where said drum holder is inserted from outside via said support hole formed on said side plate of said first part, said drum holder shaft supports said photoconductive drum and said coupling portion is coupled with said support hole formed on said side plate of said first part, while said second-part holder shaft is positioned outside said side plate of said first part, said connecting portion of said second part is inserted between said side plate of said first part and said grip portion of said drum holder by advancing said opened end of said opened bearing groove of said connecting portion in a direction parallel to said flat faces of said second-Part holder shaft, and said drum holder is locked in an axial direction by engaging said inserted connecting portion of said second part with said projections formed on said cylindrical surface of said coupling portion of said drum holder.

4. A process cartridge comprising:

a process cartridge case having a drum housing accommodating a photoconductive drum and separable into a first part and a second part along a border in a region of said drum housing, at least one leg provided on an outer surface of said process cartridge case at a region corresponding to a toner hopper, so that said leg supports said process cartridge case in an upright condition where a discharged toner box is positioned at a top of said process cartridge case and said toner hopper is positioned at a bottom of said process cartridge case; and a drum holder holding said photoconductive drum in said drum housing of said process cartridge case; wherein said first part includes said toner hopper and has a side plate with a support hole opened at a position corresponding to an axial end of said photoconductive drum, said support hole including a stopper;

said second part includes said discharged toner box and has a connecting portion with an opened bearing groove that is narrowed at an opened end;

said drum holder being inserted from an outside of said process cartridge case into an inside space of said process cartridge case via said support hole of said first part for rotatable supporting said photoconductive drum and said drum holder being coupled with said connecting portion of said second part so as to assemble said photoconductive drum, said first part and said second part;

an inlet of said discharged toner box of said second part that is directed in a downward direction when said process cartridge case is held by said leg in said upright condition where said toner hopper is positioned at the bottom of said process cartridge case, and said second part is detachable from said first part only when said second part is rotated about said drum holder to direct said inlet of said discharge toner box to a predetermined angular direction higher than said downward direction, so that said narrowed opened end of said bearing groove is disengaged from said drum holder and said photoconductive drum is exposed from an upper portion of said process cartridge case.

5. A process cartridge comprising:

a process cartridge case having a hole on a side wall thereof;

a rotary member provided at a predetermined position in said process cartridge case; and a holder member for rotatably supporting an axial end of said rotary member, wherein said holder member is detachably inserted from outside into an inside space of said process cartridge case through said hole formed on said side wall of said process cartridge case for supporting said rotary member at said predetermined position in said process cartridge case.

6. The process cartridge in accordance with claim 5, wherein said rotary member is a charging roller and said holder means urges said charging roller toward a photoconductive roller provided in said process cartridge case.

7. A process cartridge comprising:

a process cartridge case including a toner hopper storing toner;

an agitator having an agitator shaft extending beyond a side wall of said process cartridge case and protruding in a cantilever fashion;

a box formed integrally with said side wall of said process cartridge case and surrounding an extended end of said agitator shaft, said box having an inner cylindrical surface and an annular ridge defining an opening having a diameter smaller than that of said inner cylindrical surface:

an elastic member accommodated in said box;

a bearing member inserted in said box and held by said annular ridge for rotatably supporting said agitator shaft;

wherein said bearing member has at least one deformable hook integrally formed and engaged with said annular ridge for locking said bearing member with said box, while said bearing member compresses said elastic member when said bearing member is installed in position inside said box so that an inside space of said box is hermetically sealed by said elastic member.

* * * * *